US007051842B2

(12) United States Patent
Chen

(10) Patent No.: US 7,051,842 B2
(45) Date of Patent: May 30, 2006

(54) EMERGENCY MOVING DEVICE OF AN ELEVATOR

(75) Inventor: Yung-Hsin Chen, Yung Kang (TW)

(73) Assignee: Tseng-Wei Su, Tainan Hsien (TW)

( * ) Notice: Subject to any disclaimer, the term of this patent is extended or adjusted under 35 U.S.C. 154(b) by 408 days.

(21) Appl. No.: 10/614,172

(22) Filed: Jul. 8, 2003

(65) Prior Publication Data

US 2004/0020726 A1 Feb. 5, 2004

Related U.S. Application Data

(63) Continuation-in-part of application No. 09/901,713, filed on Jul. 11, 2001, now abandoned.

(51) Int. Cl.
*B66B 1/40* (2006.01)
*B66B 5/02* (2006.01)

(52) U.S. Cl. ..... 187/306; 187/291; 187/314

(58) Field of Classification Search ..... 187/250, 187/251, 255, 263, 284, 291, 298, 306, 314, 187/348, 349

See application file for complete search history.

(56) References Cited

U.S. PATENT DOCUMENTS

| | | | | |
|---|---|---|---|---|
| 276,784 | A * | 5/1883 | Daso | 187/266 |
| 1,301,924 | A * | 4/1919 | Evangelist | 187/348 |
| 2,086,002 | A * | 7/1937 | Shepard | 187/255 |
| 3,215,227 | A * | 11/1965 | Macchesney | 187/271 |
| 4,364,453 | A * | 12/1982 | Serina | 187/291 |
| 4,592,450 | A * | 6/1986 | Schaffer | 187/263 |
| 5,680,911 | A * | 10/1997 | Wang | 187/263 |
| 5,713,433 | A * | 2/1998 | Wang | 187/263 |
| 6,273,216 | B1 * | 8/2001 | Kocher et al. | 187/263 |
| 6,464,041 | B1 * | 10/2002 | Chen | 187/298 |
| 6,464,043 | B1 * | 10/2002 | Wang | 187/314 |
| 6,494,296 | B1 * | 12/2002 | Lindegger et al. | 187/399 |
| 6,598,709 | B1 * | 7/2003 | Bammert | 187/306 |
| 6,739,431 | B1 * | 5/2004 | Wang | 187/306 |
| 6,892,862 | B1 * | 5/2005 | Helmle | 187/306 |

* cited by examiner

*Primary Examiner*—Dean J. Kramer
(74) *Attorney, Agent, or Firm*—Rosenberg, Klein & Lee

(57) ABSTRACT

An emergency moving device of an elevator includes a reduction gear, several first gears coupled to a shaft of the reduction gear, a first connector releasably coupled to the car, a second connector affixed to the car and releasably coupled to the first connector, a fall-prevention device releasably coupling the first connector to the second connector, and chains respectively connected to the first connector and engaging the first gears. The first connector is coupled to the steel ropes used for vertically displacing the elevator car. When the car is stopped between floors by a power failure, the passengers press an emergency button to uncouple the first connector from the second connector, so that the car is allowed to move downwardly relative to the first connector until it arrives at a next floor with the reduction gear reducing speed of the car.

6 Claims, 6 Drawing Sheets

EMERGENCY MOVING DEVICE OF AN ELEVATOR

REFERENCE TO RELATED APPLICATIONS

This Patent Application is a Continuation-in-Part of patent application Ser. No. 09/901,713, filed Jul. 11, 2001, entitled "Emergency Moving Device of an Elevator", now abandoned.

BACKGROUND OF THE INVENTION

1. Field of the Invention

The present invention relates to an emergency moving device of an elevator, which can help the car of the elevator to move down to a next floor of the building when breakdown or power failure happens, and causes the car to stop between the floors.

2. Brief Description of the Prior Art

Referring to FIG. 9, a conventional elevator has a car 10, steel ropes 20, a main motor 30, and a balance weight 40.

The car 10 is up and down movable in a longitudinal passage of a building. The main motor 30 is fixedly disposed above the longitudinal passage of the building. The steel ropes 20 are connected to a top of the car 10 at first ends, and passed over a rotary member (not shown) of the main motor 30. The balance weight 40 is connected to the other ends of the steel ropes 20. Thus, the car 10 can be moved up and down along the longitudinal passage to transport people from one floor to others.

However, the motor 30 will stop running to prevent the car 10 from falling down in case of power failure or breakdown of the elevator. Consequently, when there is power failure or breakdown of the elevator, the car 10 is likely to stop between two adjacent ones of the floors, and the passengers can't get off the car 10 safety until the breakdown or power failure is handled, and the car 10 is moved to one of the floors normally again. In other words, the passengers usually have to wait anxiously in the car 10 for a relatively long period of time until the breakdown or power failure is fixed.

SUMMARY OF THE INVENTION

Therefore, it is a main object of the present invention to provide an emergency moving device to an elevator such that the car member of the elevator is allowed to move to a lower one of two adjacent floors for the passengers to get off the elevator without delay after power failure or breakdown has happened, and forced the car member to stop between the floors.

The emergency moving device includes:

- a main moving gear disposed on a top of a car member of the elevator;
- a reduction gear fixed on top of the car member and connected to the main moving gear;
- several first gears coupled to a shaft of the reduction gear for imparting a turning movement to the shaft of the reduction gear and thereby drive the main moving gear;
- a first connecting member releasably coupled to the car member, the first connecting member being coupled to steel ropes of the elevator used for vertically displacing the car member;
- a second connecting member affixed to the car member and releasably coupled to the first connecting member by means of a fall prevention device;

- several chains respectively connected the first connecting member and engaging the first gears;
- a braking switch connected to the main moving gear for releasably locking the main moving gear; and
- a hydraulic governor coupled to the main moving gear.

When the car member is stopped between floors by a power failure, the passengers of the elevator press an emergency button to make the fall-prevention device uncouple the first connecting member from the second connecting member, and to make the braking switch unlock the main moving gear from the locked position so that the car member is allowed to move down relative to, and away from, the first connecting member until it arrives at a next floor with the chains being displaced relative to the first gears, with the reduction gear reducing speed of the car member, and with the main moving gear being driven to rotate against a resistance provided by the hydraulic governor.

BRIEF DESCRIPTION OF THE DRAWINGS

This invention will be better understood by referring to the accompanying drawings, wherein.

DETAILED DESCRIPTION OF THE PREFERRED EMBODIMENT

Referring to FIGS. 1, 2, 3 and 4, an elevator is provided with the emergency moving device of the present invention. The elevator includes a car member 1, steel ropes 20, a main motor 30, and a balance weight 40. The steel ropes 20 are passed around the main motor 30, and each connected to the balance weight 40 at first end. The car member 1 is received in a longitudinal passage of a building.

Figure 6:
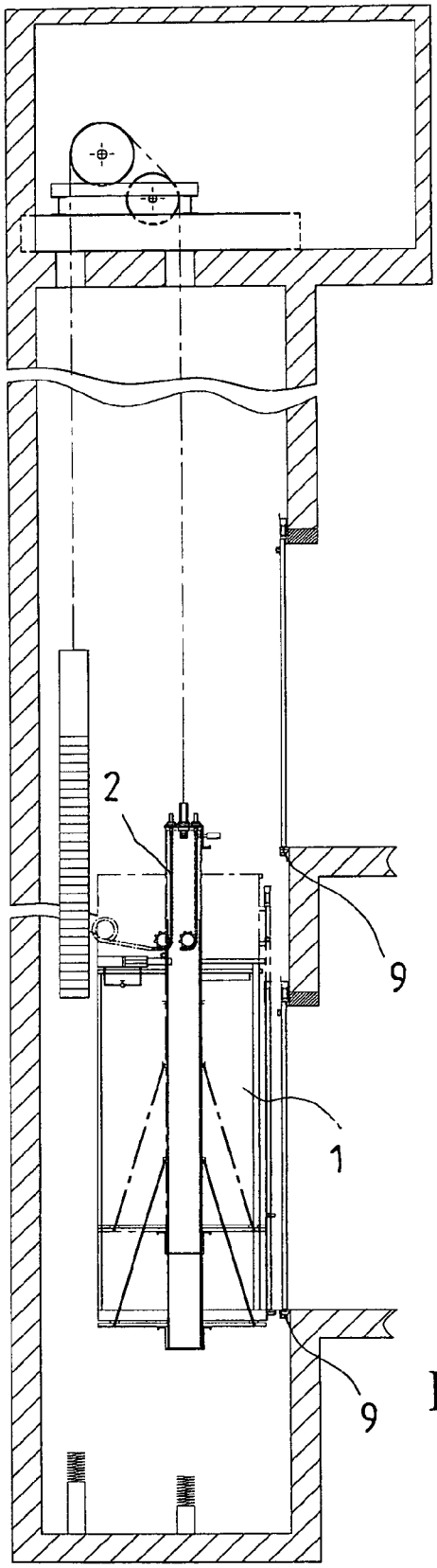
FIG. 6 is a side view of the elevator in FIG. 2 with the car being lowered to a nearest floor in emergency.
Figure 7:
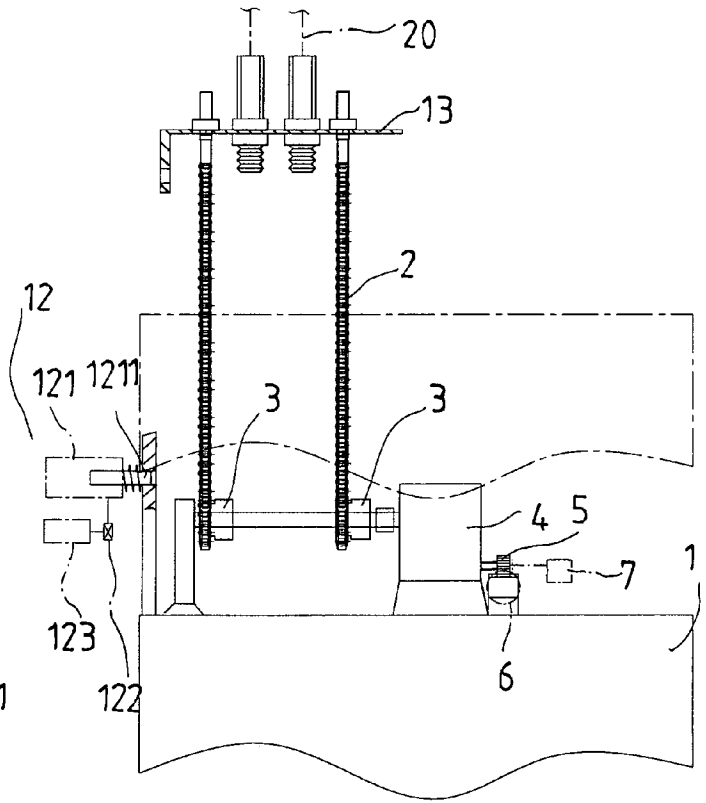
FIG. 7 is a partial front view of the emergency moving device of the present invention, working in an emergency.
Figure 8:
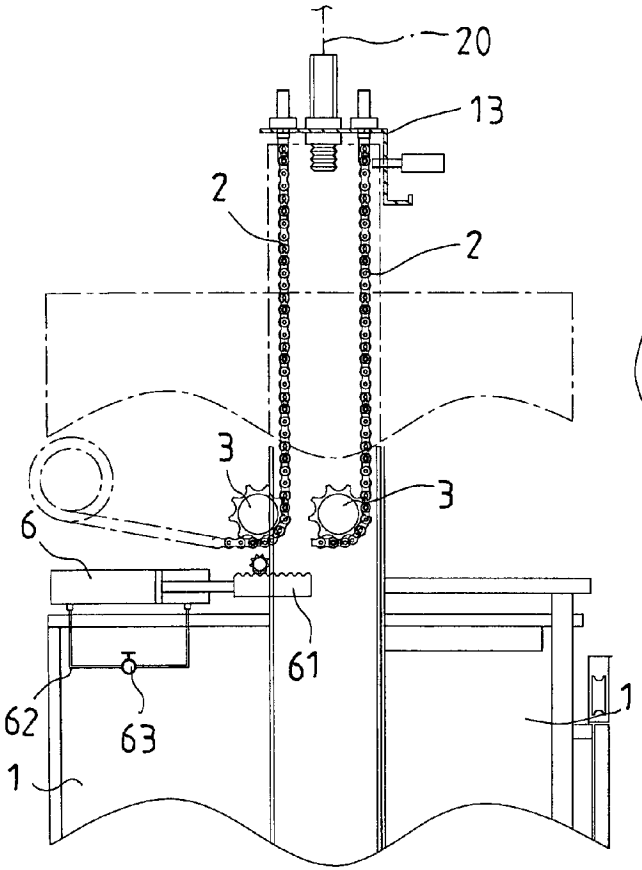
FIG. 8 is a partial side view of the emergency moving device of the present invention, working in an emergency.
Figure 9:
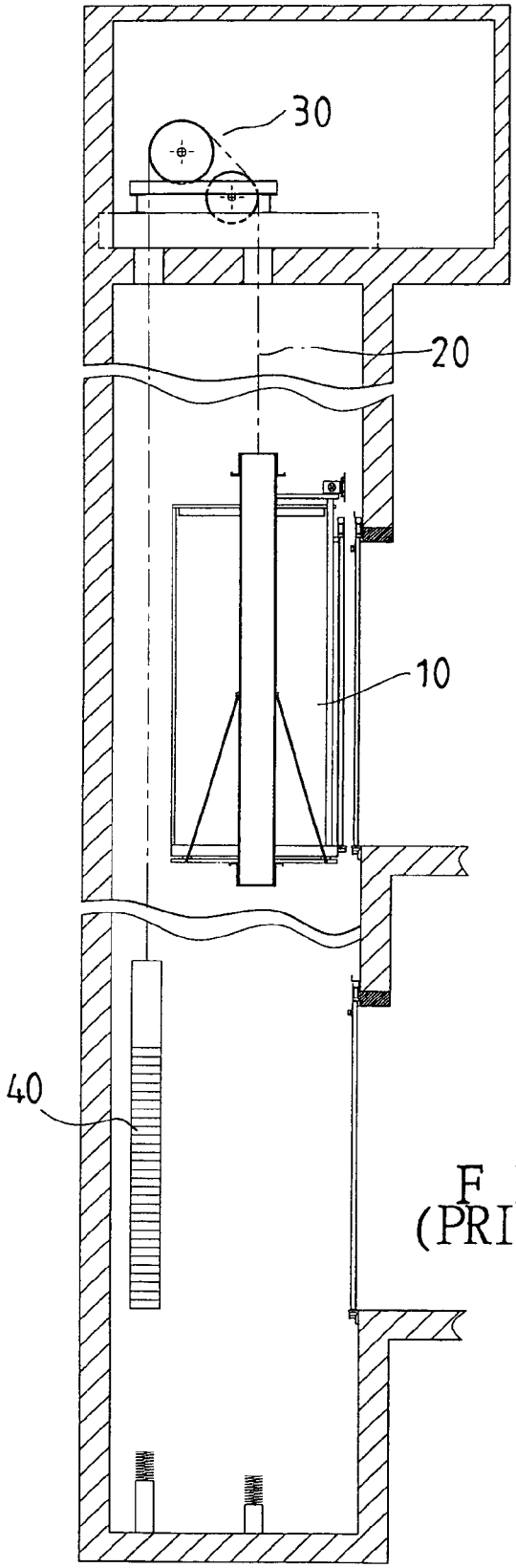
FIG. 9 (PRIOR ART)
FIG. 9 is a side view of the conventional elevator as described in the Background.

The emergency moving device includes a first connecting member 13, a second connecting member 11, a hydraulic governor 6, several chains 2, gears 3, a main moving gear 5, a fall prevention device 12, a reduction gear 4, a braking switch 7, an emergency power supply 8, an emergency control button (not shown) in the car member 1, and sensors 9 (FIG. 6).

The first connecting member 13 is releasably coupled to top of the car member 1, and connected to the second ends of the steel ropes 20 at the upper side thereof. The first connecting member 13 further has a lateral portion, which sticks down from a horizontal portion of the member 13, and which has a connecting through hole (not shown).

Figure 2:
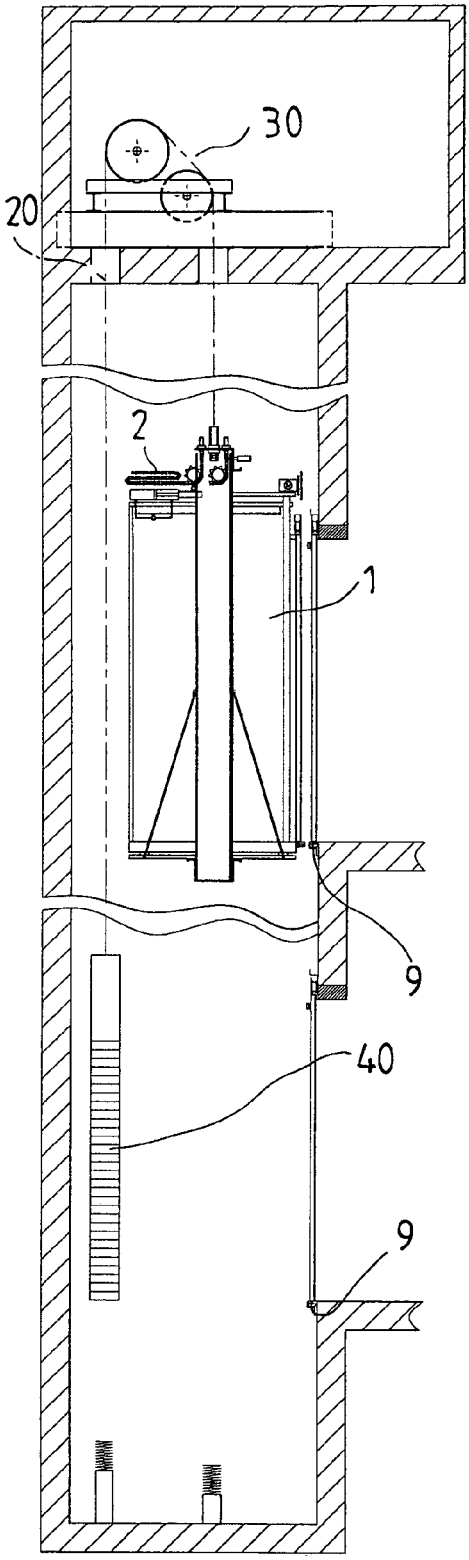
FIG. 2 is a side view of the elevator with the emergency moving device of the present invention.
Figure 1:
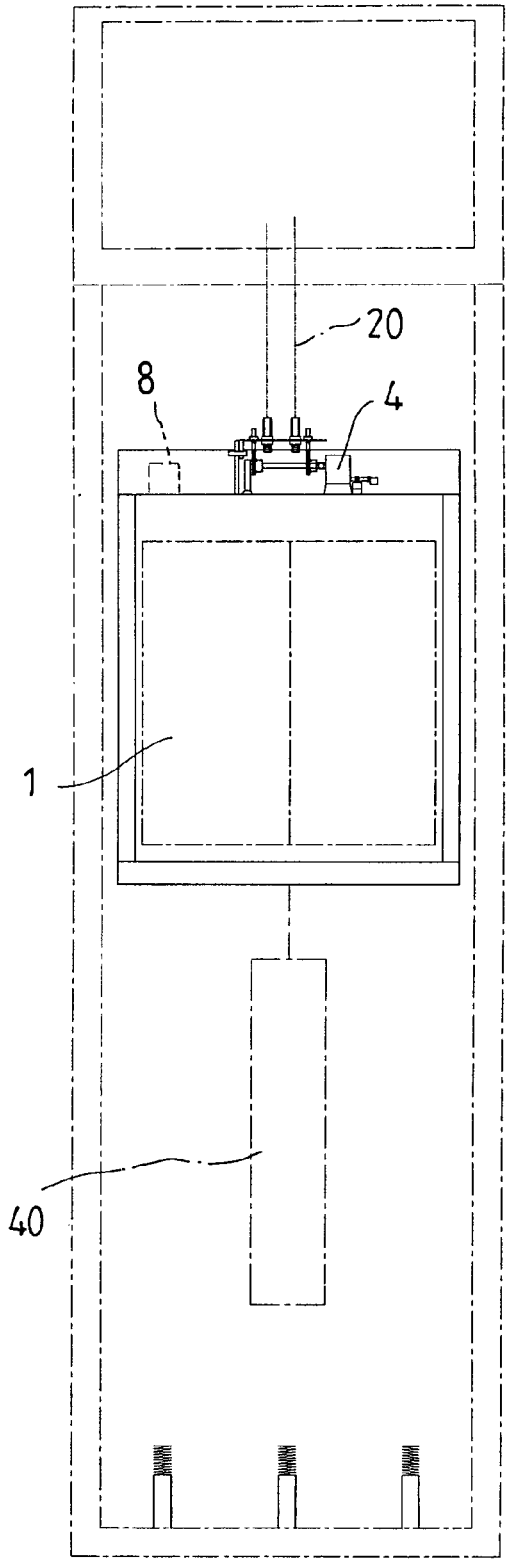
FIG. 1 is a front view of an elevator with the emergency moving device of the present invention.
Figure 3:
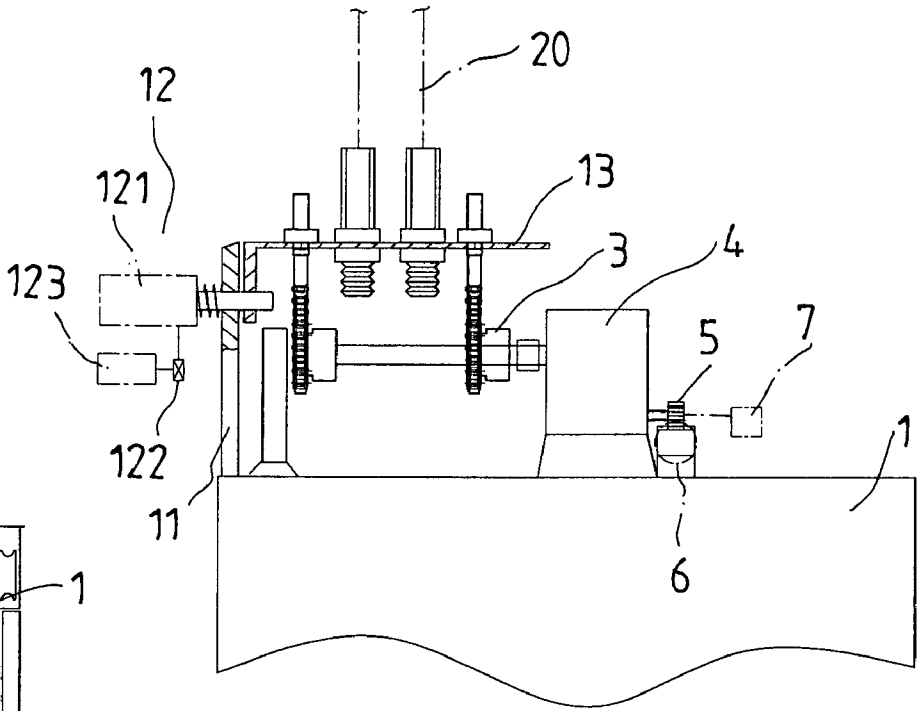
FIG. 3 is a partial front view of the emergency moving device of an elevator according to the present invention.
Figure 4:
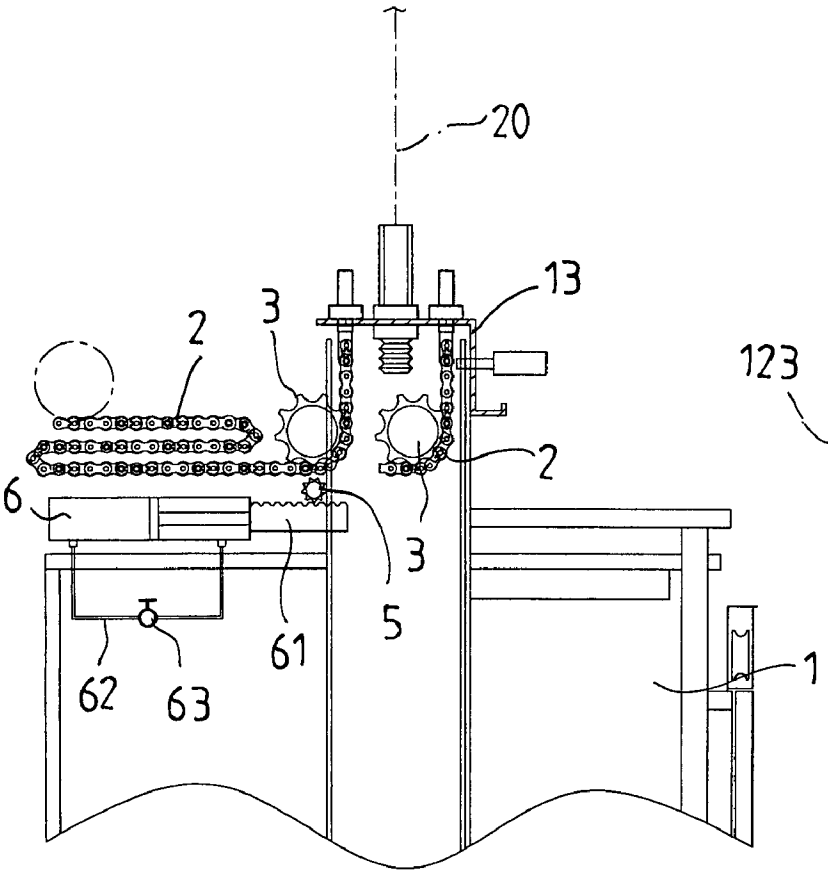
FIG. 4 is a partial side view of the emergency moving device of an elevator according to the present invention.
Figure 5:
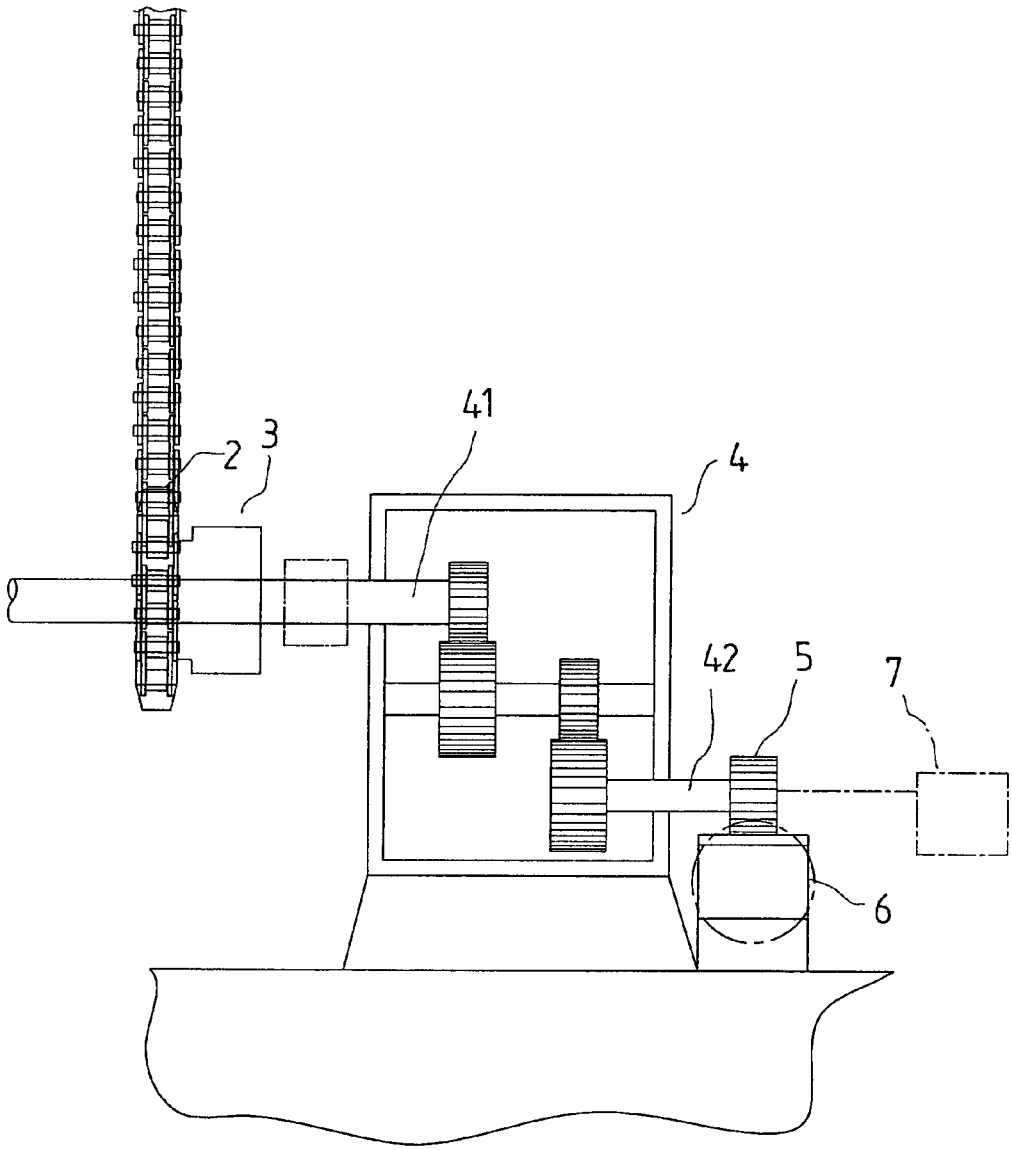
FIG. 5 is a plan of the reduction gear of the emergency moving device of the present invention in association with other parts.

Referring to FIG. 5, the reduction gear 4 is fixedly disposed on top of the car member 1. The reduction gear 4 includes inner parts (not numbered), several first shafts 41 connected to the inner parts, and a second shaft 42 also connected to the inner parts so that rotation of the first shafts 41 is passed on to the second shaft 42.

The gears 3 are connected to respective ones of the first shafts 41 of the reduction gear 4. The chains 2 are connected to the lower side of the first connecting member 13 at first ends, and connected to a reel or other storing equipment (not numbered) at second ends thereof. The chains 2 are respectively passed over, and engaged with, the gears 3 so that movement of the chains 2 relative to the gears 3 will cause rotation of the gears 3.

The main moving gear 5 is connected to the second shaft 42 of the reduction gear 4, and is connected to the braking switch 7; the braking switch 7 can function to prevent the main moving gear 5 from rotating when the elevator is working properly.

The hydraulic governor 6 is also fixedly disposed on the top of the car member 1. The hydraulic governor 6 includes an oil return pipe 62, a governor valve 63, and a moving toothed bar 61. The governor valve 63 is coupled in fluid communication with the oil return pipe 62 such that when certain force is exerted to displace moving toothed bar 61, the speed of the movement of the moving toothed bar 61 can be adjusted by means of the governor valve 63. The moving toothed bar 61 has engaging teeth (not numbered) formed along the upper side. The main moving gear 5 is engaged with the moving toothed bar 61 so that rate of rotation of the main moving gear 5 is controlled by the hydraulic governor 6.

The emergency power supply 8 is electrically connected to the emergency control button provided in the car member 1, and is electrically connected to both the braking switch 7 and the fall prevention device 12. The controllers 9 are disposed substantially as high as corresponding floors of the building to face the longitudinal passage of the building, and are electrically connected to the braking switch 7, and are connected to the emergency control button so that it will begin to function when the emergency control button is pressed to activate the present emergency moving device in power failure. Each of the controllers 9 includes a sensor (not shown), which is provided for sensing that the car member 1 moves to the respective floor when the controller 9 is made to function; when sensor of one of the controllers 9 senses that the car member 1 moves to the corresponding floor, the controller 9 will function to control the braking switch 7 so that the main moving gear 5 is locked with the braking switch 7.

The fall prevention device 12 includes an oil hydraulic cylinder 121, an oil drain valve 122, and an oil container 123. The oil hydraulic cylinder 121 has a piston rod 1211.

The second connecting member 11 is fixedly disposed on the top of the car member 1, and has a connecting through hole (not shown); the connecting through hole of the second member 11 will be aligned with the connecting through hole of the first connecting member 13, and the piston rod 1211 will be inserted into both connecting through holes when the elevator is working properly. In other words, when the elevator is working properly, the first and the second connecting members 13 and 11 are coupled to each other by means of the piston rod 1211, and in turns, the car member 1 can't move relative to the first connecting member 13.

When the car member 1 is forced to stop between two adjacent ones of the floors of the building due to power failure or breakdown of the elevator, the passengers in the car member 1 push the emergency control button in the car member 1 to activate the emergency power supply 8. Thus, the oil drain valve 122 is opened for permitting oil to flow into the oil container 123 from the hydraulic cylinder 121 so that the piston rod 1211 retreats from the connecting through holes of both the first and the second connecting members 13 and 11 for permitting the car member 1 to move relative to the first connecting member 11. At the same time, the braking switch 7 is activated to release the main moving gear 5 from the locked position so that the gear 5 is allowed to turn. Consequently, the car member 1 moves down relative to the first connecting member 11 due to gravity, causing the gears 3 to rotate along the respective chains 2; thus, the first and the second shafts 41 and 42 of the reduction gear 4, and the main moving gear 5 rotate together with the gears 3 with the reduction gear 4 slowing down the downward movement of the car member 1, and with the hydraulic governor 6 also providing a resistance against rotation of the main moving gear 5.

When the car member 1 moves down to a next floor subsequent to activation of the emergency moving device, sensor of the corresponding controller 9 of this floor senses this fact immediately, and the corresponding controller 9 makes the braking switch 7 stop the main moving gear 5 from turning any longer. Thus, the car member 1 is stopped on the floor to allow the passengers in the car member 1 to easily and safely get off the car member 1.

After the power failure or breakdown of the elevator is fixed, the car member 1 is moved to the lowermost floor with functioning of the main motor 30. Then, the braking switch 7 is controlled to release the main moving gear 5 from the locked position, and the gears 3 and the motor 30 are made to turn such that the first connecting member 13 moves close to the car member 1, and at the same time the chains 6, while engaged with the gears 3, are wound back around the storing equipments. Finally, the braking switch 7 is controlled to lock the main moving gear 5 in the locked position, and the fall prevention device 12 is controlled for the piston rod 1211 to pass through the connecting holes of the connecting member 11 and 13; thus, the car member 1 is prevented from moving relative to the first connecting member 13, and can be used in the normal way.

From the above description, it can be seen that the emergency moving device of an elevator according to the present invention allows the car member to move down to a next floor exactly and without delay after a breakdown or power failure of the elevator therefore the passengers can get off the elevator safely and easily without having to suffer from waiting a long time.

What is claimed is:

1. An emergency moving device of an elevator, comprising a main moving gear disposed on a top of a car member of the elevator;

a reduction gear fixed on top of said car member and coupled to said main moving gear;

a plurality of gears coupled to a shaft of said reduction gear for imparting a turning movement to said shaft of said reduction gear and thereby drive said main moving gear;

a first connecting member releasably coupled to the car member, said first connecting member being coupled to steel ropes of the elevator used for vertically displacing the car member;

a second connecting member affixed to the car member and releasably coupled to said first connecting member;

a plurality of chains respectively being connected on one end thereof to said first connecting member and respectively engaging said plurality of gears;

a braking switch releasably engageable with said main moving gear for blocking and unblocking rotation of said moving gear;

a hydraulic governor coupled to said main moving gear; and, a fall prevention device releasably coupling said first connecting member to said second connecting member;

whereby when the car member is stopped between floors by a power failure, said fall prevention device is operable to uncouple said first connecting member from said second connecting member in correspondence with release of said braking switch from engagement with said main moving gear to thereby lower the car member relative to said first connecting member responsive to displacement of said plurality of chains at a rate controlled by said hydraulic governor, said displacement of said plurality of chains driving said plurality of gears to rotate, said main moving gear being driven to rotate against a resistance provided by said hydraulic governor through rotation of said shaft of said reduction gear responsive to side rotation of said plurality of gears.

2. The emergency moving device of an elevator as claimed in claim 1, wherein portions of said plurality of chains are respectively wound around storing equipment.

3. The emergency moving device of an elevator as claimed in claim 1, wherein said fall prevention member includes an oil hydraulic cylinder having a piston rod removably passing through respective holes formed in each of said first and second connecting members for releasably coupling said first connecting member to said second connecting member.

4. The emergency moving device of an elevator as claimed in claim 1, wherein said hydraulic governor includes a moving toothed bar engaged with said main moving gear.

5. The emergency moving device of an elevator as claimed in claim 4, wherein said hydraulic governor further includes a hydraulic cylinder connected to said toothed bar, said hydraulic cylinder including an oil return pipe, and a governor valve coupled in fluid communication with said oil return pipe for adjusting a displacement rate of said toothed bar engaging said main moving gear.

6. The emergency moving device of an elevator as claimed in claim 1, further comprising a positioning sensor for detecting a position of the car member, said braking switch being operated, responsive to the car member being detected by said positioning sensor, to engage and block said main moving gear from turning when said car is lower to a predetermined position subsequent to said uncoupling said first connecting member from said second connecting member.

* * * * *